US008099935B2

(12) United States Patent
Forni et al.

(10) Patent No.: US 8,099,935 B2
(45) Date of Patent: Jan. 24, 2012

(54) METHOD AND APPARATUS FOR FIXING THE TAIL END OF THE FILM FOR WRAPPING PALLETIZED LOADS

(75) Inventors: Angelo Forni, Riccione (IT); Gianluca Paci, Province of Rimini (IT)

(73) Assignee: Atlanta Stretch S.p.A., Rimini (IT)

( * ) Notice: Subject to any disclaimer, the term of this patent is extended or adjusted under 35 U.S.C. 154(b) by 348 days.

(21) Appl. No.: 12/531,102

(22) PCT Filed: Mar. 13, 2008

(86) PCT No.: PCT/IB2008/050924

§ 371 (c)(1),
(2), (4) Date: Sep. 14, 2009

(87) PCT Pub. No.: WO2008/114179

PCT Pub. Date: Sep. 25, 2008

(65) Prior Publication Data

US 2010/0037562 A1 Feb. 18, 2010

(30) Foreign Application Priority Data

Mar. 16, 2007 (IT) ..... BO2007A0183

(51) Int. Cl.
*B65B 11/04* (2006.01)

(52) U.S. Cl. ..... 53/587; 53/399; 53/441; 53/556; 53/588

(58) Field of Classification Search ..... 53/397, 53/399, 441, 556, 587, 588, 217, 227
See application file for complete search history.

(56) References Cited

U.S. PATENT DOCUMENTS

| | | | | |
|---|---|---|---|---|
| 4,216,640 | A | 8/1980 | Kaufman | |
| 5,802,810 | A * | 9/1998 | Wojcik et al. | 53/399 |
| 6,453,643 | B1 | 9/2002 | Buscherini et al. | |
| 7,305,809 | B2 * | 12/2007 | Casadei | 53/556 |
| 2004/0182050 | A1 | 9/2004 | Pieri | |

* cited by examiner

*Primary Examiner* — Lindsay Low
*Assistant Examiner* — Andrew M Tecco
(74) *Attorney, Agent, or Firm* — Stites & Harbison PLLC; Marvin Petry

(57) ABSTRACT

Method and apparatus for fixing the tail end of the film for wrapping palletized loads, supplied by a reel (B), envisages the following working steps: a) Positioning along the side of the load and parallel thereto a straight member (1) and transversely extending over it a section of a penultimate turn (S) of the wrapping film so as to form a vertically open pocket (Z) between this turn and the wrapped load; b) Moving an edge of the film portion of the said penultimate turn which touches the said straight member towards the other edge of the said turn so as to free space on the said straight member (1); c) Extending over the free space of said straight member (1) a section of a last turn (S1) of the wrapping film,—d) The part of the said last turn (S1) situated on the said straight member is moved away from the said penultimate turn (S), is made to pass over the said straight member (1) and is inserted and pulled into the said pocket (Z), remaining temporarily connected to the said distributor with the reel (B); e) The part of the said penultimate turn situated on the said straight member (1) is made to pass over this member, coming out from the same end from where the tail end came out, so as to close the said pocket.

18 Claims, 4 Drawing Sheets

METHOD AND APPARATUS FOR FIXING THE TAIL END OF THE FILM FOR WRAPPING PALLETIZED LOADS

The invention concerns a method and the associated apparatus for automatically fixing the tail end of a wrapping of extendable film provided on loads which are usually palletized by any type of wrapping machine, both of the so-called rotating-table type, where the load placed on the table is rotated about its central axis and the wrapping film is unwound from a distributor driven on a vertical shaft, and of the rotating-arm or ring type, where the load remains stationary, while the said film distributor is displaced parallel to the axis of the load and around the load itself.

At present there exist automatic apparatus which perform the said operation of automatically fixing the tail end of the wrapping film, with insertion of the tail end in a pocket created in at least one penultimate turn of the said wrapping. The known apparatus are constructionally complex, bulky and at the end of the cycle have a component which is still inserted inside the turn of film inside which the pocket has been formed and the tail end of the wrapping has been introduced, so that the working cycle of the wrapping machine must be slowed down in order to allow extraction of the said component. In order to avoid this drawback, the said component is sometimes designed with the possibility of pivoting about a bottom axis transverse to the path of the load, not perpendicular to this path, so as to be extracted automatically from the wrapping while the load moves away from the wrapping station. This solution complicates the apparatus in terms of its construction and, while the said component pivots downwards, its top end touches the wrapped load and may also damage it even if this end is rounded and is designed to be freely rotatable. In the known devices, insertion of the tail end in the pocket created in the film wrapping is generally performed by gripper means which at a certain point require the operation of air jets in order to retain the tail end inside the pocket while these gripper means open and perform the stroke for extraction from the said pocket. This solution complicates further the design of the apparatus and results in problematic and uncertain fixing of the tail end since it is not controlled positively for the whole of the fixing cycle.

The invention intends to overcome these drawbacks of the prior art with an apparatus as claimed in Claim 1 and the following dependent claims, based on the following proposed solution. During the last stages of the wrapping cycle, a straight member of suitable height is arranged along the side of the load and parallel to the latter, said member supporting longitudinally a conveyor which forms a closed loop and is driven on pulleys which are located at the ends of this member and one of which may be actuated by a command received from a small gear motor. When the said member is in the active position, along the side of the wrapped load, a section of its conveyor is directed towards the load while the other section is situated opposite and facing outwards. At least two teeth are fixed onto the said conveyor and at the start of each cycle are positioned at the opposite ends of the member in question. The working cycle envisages that at least one penultimate turn is wound onto the load and positioned transversely on the said straight member in the active position, so as to form a pocket inside this turn and it is envisaged that the portion of this penultimate turn which rests on the said straight member is shortened transversely towards one of its edges, by a tooth of the said conveyor, so as to free the space sufficient for arranging on the said straight member a section of a last turn of the wrapping film. In sequence, the tooth which previously had shortened transversely the said penultimate turn is actuated in the opposite direction so as to clasp transversely the last turn, push it so that it comes out of the member in question and insert and pull it into the pocket of the wrapping formed by the said penultimate turn, while in synchronism the same penultimate turn is pushed transversely by the other tooth in the same direction in which the last turn was pulled out and is made to pass over the said member and extend elastically on the wrapping in order to close the said pocket, while in synchronism the portion of the said last turn trapped inside the said pocket is cut by downstream means which also retain the new leading end of the film so as to then arrange it correctly with respect to the next load to be wrapped. At the end of the working cycle, the apparatus is brought into the horizontal rest position for starting the next cycle for wrapping a new load.

Further characteristic features of the invention, and the advantages arising therefrom, will emerge more clearly from the following description of a preferred embodiment thereof, provided purely by way of a non-limiting example, in the figures of the accompanying illustrations in which:

FIG. 1 is a perspective side view of the apparatus during a first working step;

FIG. 1*a* shows details of the main component of the apparatus, viewed along the cross-sectional line A-A of FIG. 1;

In order to facilitate understanding of the invention, the description which follows is provided with reference to application of the apparatus to a rotating-table wrapping machine and in the final part of the present description it is indicated how it is possible to use the same apparatus on other types of wrapping machine.

Figure 1A:
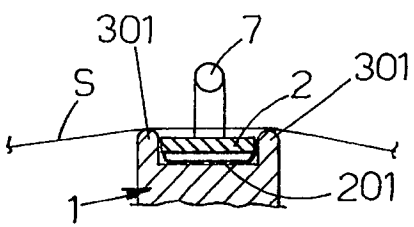
Figure 1:
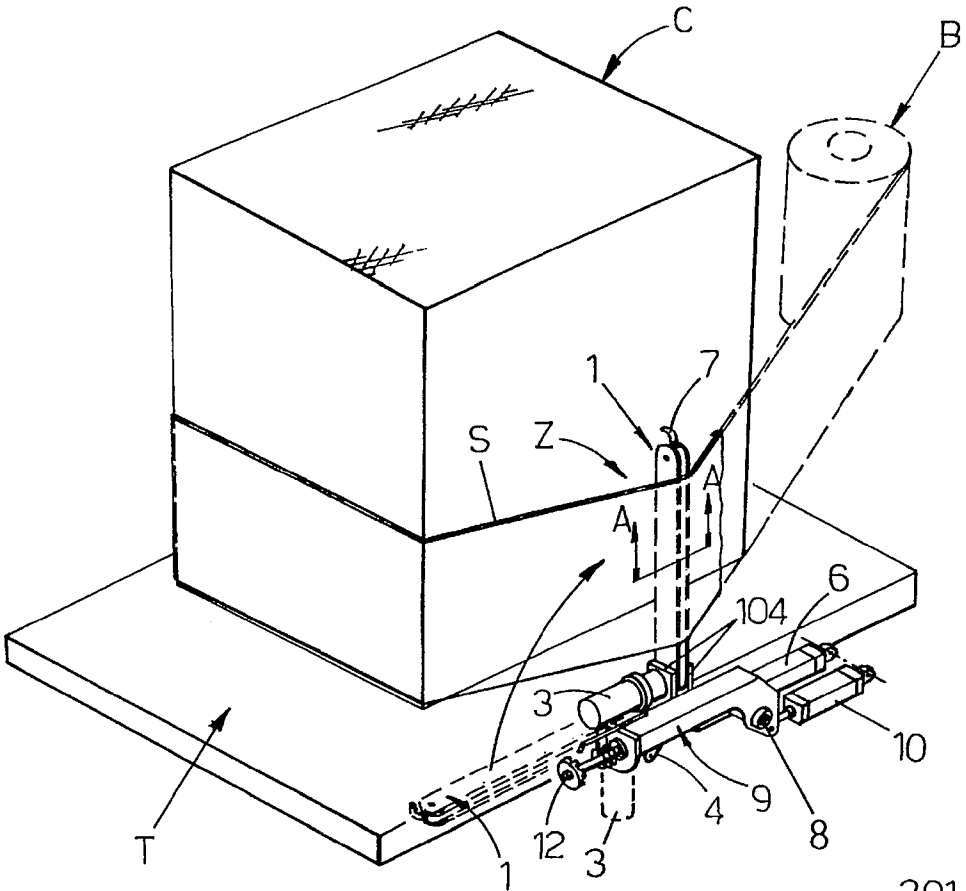

In FIG. 1, T denotes the rotating table on which the palletized load C is arranged, said load being wrapped with spiral turns of extendable film supplied by a feed device which carries the reel B of extendable film and the usual means for pre-stretching the film and which is raised and lowered by suitable means in synchronism with rotation of the table and the load. In these types of machine, the apparatus is mounted along the side of the rotating table T and comprises a first straight member 1 which has a length for example greater (see below) than the width of the extendable film as it is supplied by the distributor with the reel B, a flat form and is directed with its edge towards the load C. The member 1 has a rounded upper form 101 and at this top end has a means 102 for driving at least one conveyor, for example a toothed belt 2, which travels guided inside a longitudinal groove 201 (FIGS. 1*a*, 2) of the said member 1 which at the other end has a toothed pulley 202 keyed onto the shaft of a small gear motor 3 which is fixed on the side of the same member 1. The gear motor 3 is in reality fixed onto one of the flanges of a U-shaped support 104 which, as can be seen from FIG. 3, forms the end of an arm 4 which is pivotably joined together at 5 with the side of the rotating table T and which with the other end is connected to a reciprocating actuator, for example to the rod of a fluid-pressure cylinder and piston unit 6 hinged with the base of its body to the said table T. By means of the action of the actuator 6, the member 1 may be brought from the lowered and horizontal rest position into the raised position directed upwards, as shown in broken lines and continuous lines, respectively, in FIG. 1.

According to a preferred embodiment of the invention, as shown in the detail of FIG. 1*a*, the outer side of the conveying belt 2 is coplanar with or slightly set back from the edges 301 of the longitudinal channel 201 of the member 1 inside which this belt travels in a guided manner and these edges 301 are suitably rounded and polished or in any case treated so as to have a low coefficient of friction, since the film must be able to slide on them, as will become clear from the remainder of the description. The conveying belt 2 has, fixed thereon, oppositely synchronized, at least two teeth 7, 7' which are rounded both at the end and on the teeth, with a substantially L-shaped profile, and which at the start of each working cycle are positioned at the opposite ends of the member 1, as shown in FIG. 1. According to a constructional variant, not shown in the drawings, at least that tooth of the said teeth 7, 7' which at the start of the cycle is positioned in the vicinity of the drive means 102 of the conveyor 2 may be provided with a T-shaped side profile since this tooth is required to perform opposite operations on the penultimate and last turn of the wrapping film, as can be seen in the remainder of the description.

Figure 2:
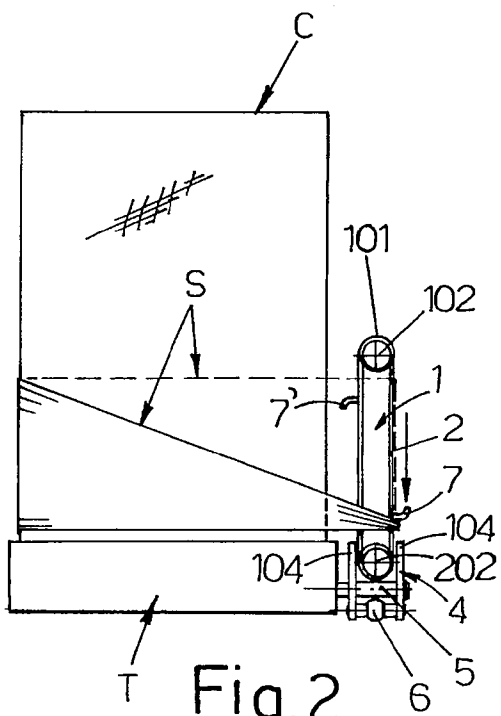
FIG. 2 shows a side view of the apparatus during the step according to FIG. 1 and during the next step.
Figure 3:
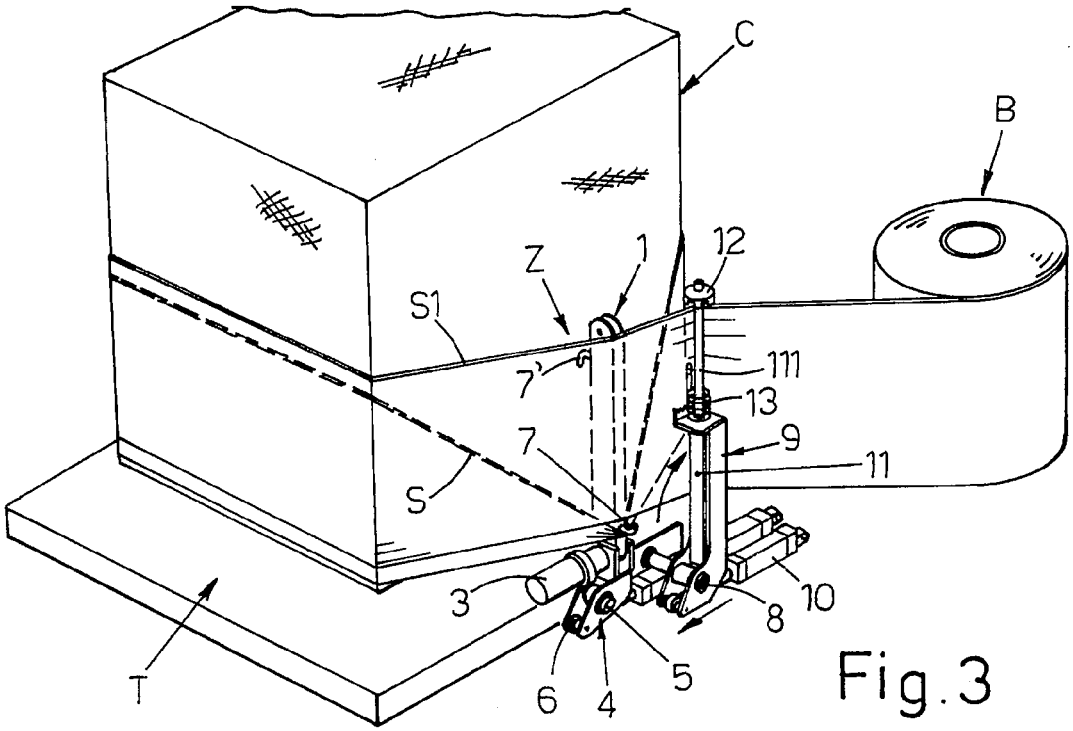
FIGS. 3, 4, 5, 6 and 7 are perspective views of the apparatus during the subsequent steps of its working cycle.

In order to be able to fix the tail end of the film for wrapping the load C it is envisaged that in synchronism the member 1 mentioned above is brought from the horizontal rest position into the raised operating position so that a section of a penultimate turn S of the wrapping film supplied by the distributor with the reel B rests transversely on the outer edge of the said member 1, as shown in FIG. 1, such that a pocket Z inside which the tail end of the wrapping film can be inserted is formed between this penultimate turn and the wrapped load C (see below). In sequence, while the table T continues to rotate at a speed which is preferably less than the operating speed, the gear motor 3 is activated so as to lower the upper tooth 7 on the outer side of the straight member 1, as shown in FIG. 2, so that the portion of the penultimate turn S which rests on the member 1 is lowered by the said tooth 7 so as to free frontally the member 1 by an amount sufficient to allow a section of a last turn S1 of the wrapping film supplied by the distributor with the reel B to be rested transversely thereon, as shown in FIG. 3, and, when these conditions are achieved, the table T stops.

At this point of the cycle the operation of another component of the apparatus is envisaged, this now being described with reference to FIGS. 1, 3, 9 and 10. Parallel to the pivot 5, in a position situated between the latter and the distributor with the reel B for feeding the film, a second pivot 8 is envisaged, said pivot being longer than the pivot 5 and supporting the middle part of the forked and right-angled base 109 of a second straight member 9 for example with a box shape and the same base 109 is hinged via its free end with a reciprocating actuator 10, for example with the rod of a fluid-pressure cylinder and piston unit in turn hinged with the base of its body on the side of the table T, similar to the cylinder 6 considered above for the other component of the apparatus. The box-shaped member 9 has, mounted and fixed inside it, the body of a cylinder and piston unit 11, the rod 111 of which projects by a suitable amount from the said member 9 and has, fixed at the end, a jaw 12 for example in the form of an overturned cup. The body of the cylinder 11 projects from the box-shaped member 9 with a tapered and cylindrical portion 211, on which one end of a short cylindrical spring 13 is fixed for example by means of friction, alongside which spring the box-shaped body 9 has, fixed thereon, an extension of its edge with which it is intended to come into contact with the said last turn S1 of the wrapping film. This extension is, for example, formed by a round metal pin 14 which is welded to the body 9 and which terminates above the said spring 13 with a rounded end 114 slightly bent towards the rod of the cylinder 11. When the apparatus is in the rest condition, the member 9 described above is in the horizontal and lowered position as can be seen from FIG. 1, alongside the member 1 which is also in the rest position. After the step shown in FIG. 2, the straight member 9 is raised into the active position as can be seen from FIG. 3, so as to co-operate with the section of the last turn S1 situated between the film distributor with the reel B and the member 1, so that this last turn S1 makes certain and uniformly distributed contact with the said member 1, while the said turn S1 touches the said last member, partly on the body 9, partly on the extension 14 and partly on the rod 111 of the cylinder 11, as shown in broken lines in FIG. 9.

Figure 4:
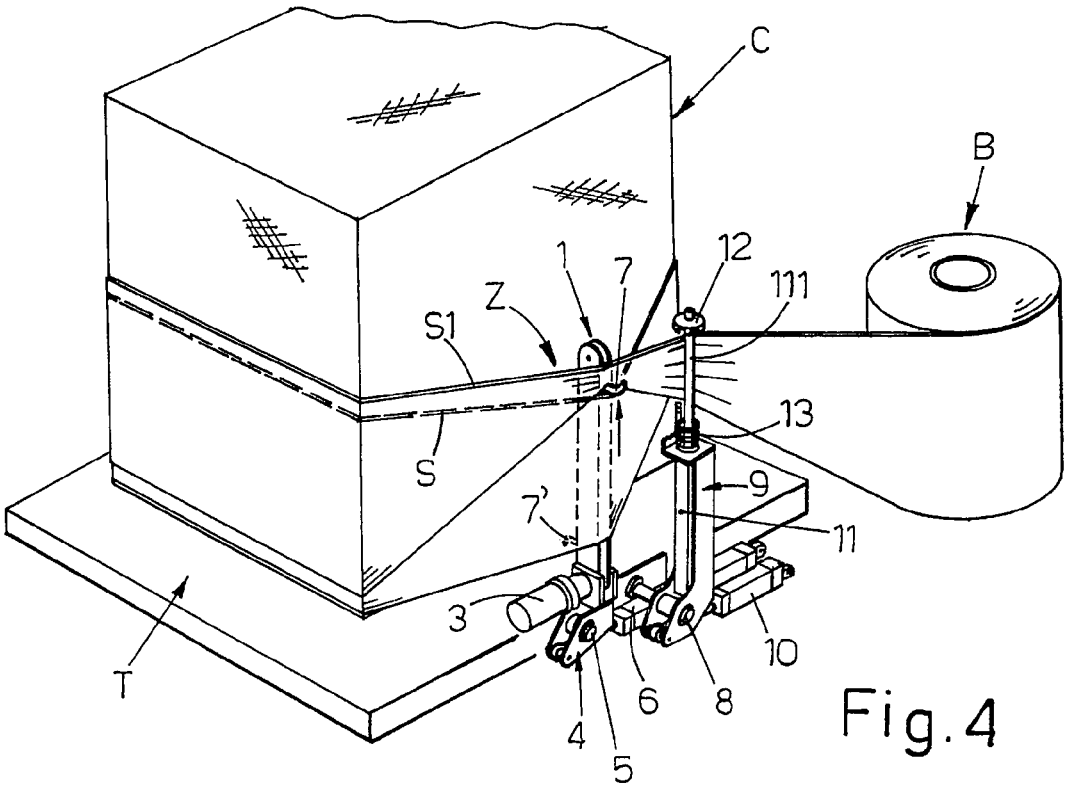
Figure 5:
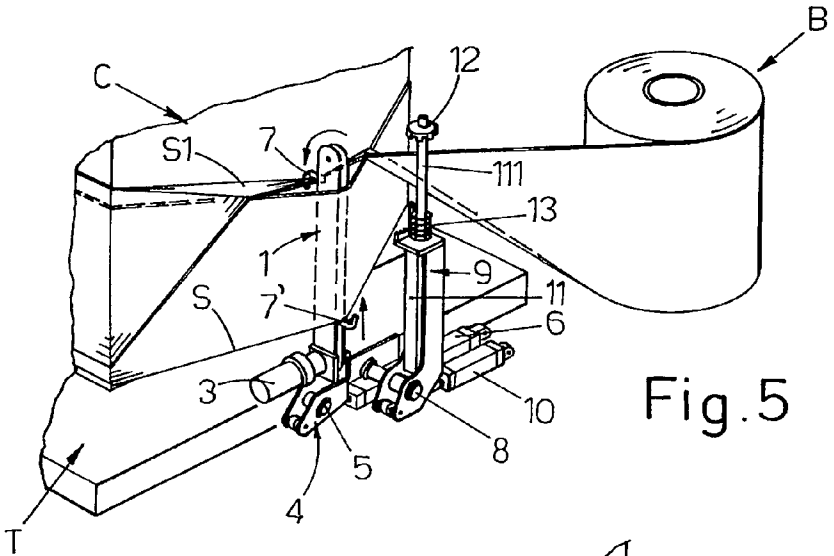
Figure 6:
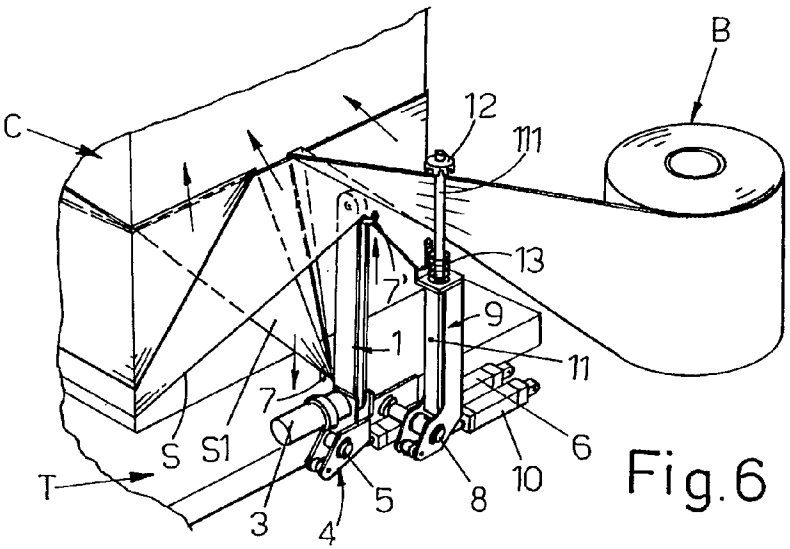
Figure 8:
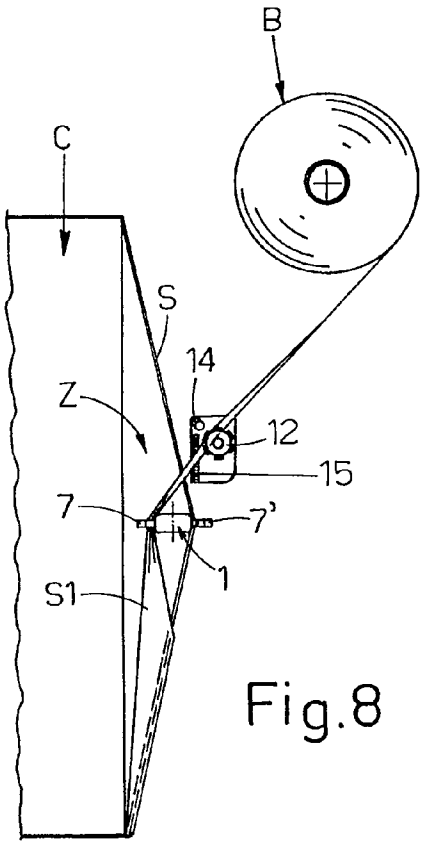
FIG. 8 is a plan view of the apparatus in the condition according to FIG. 5.
Figure 7:
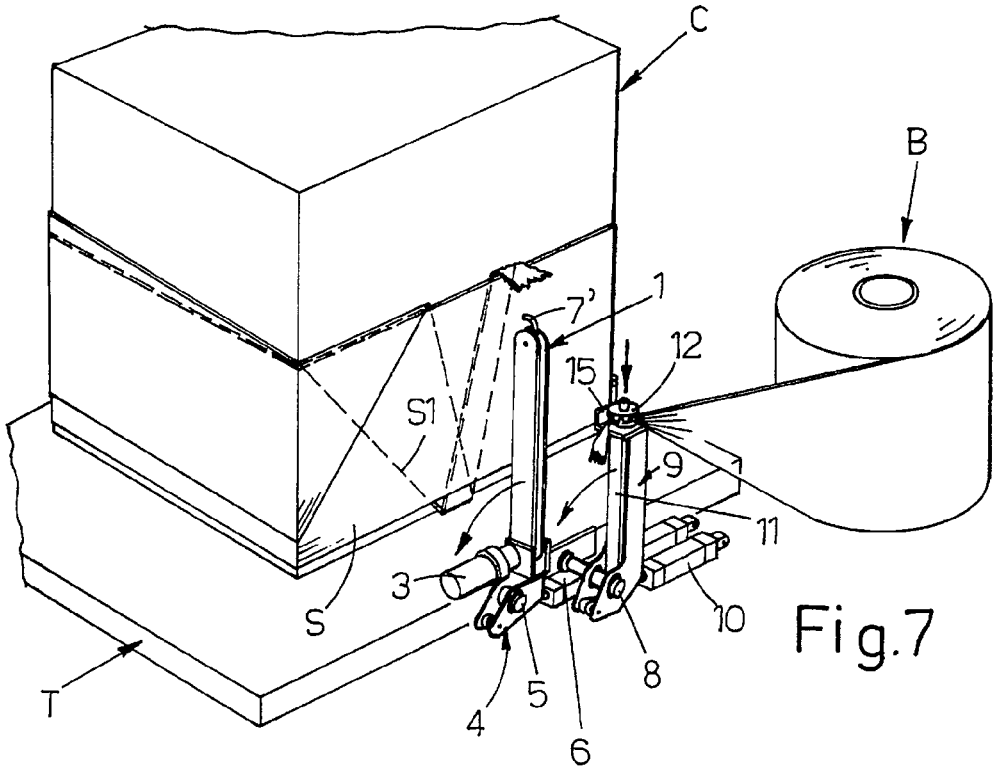
Figure 10:
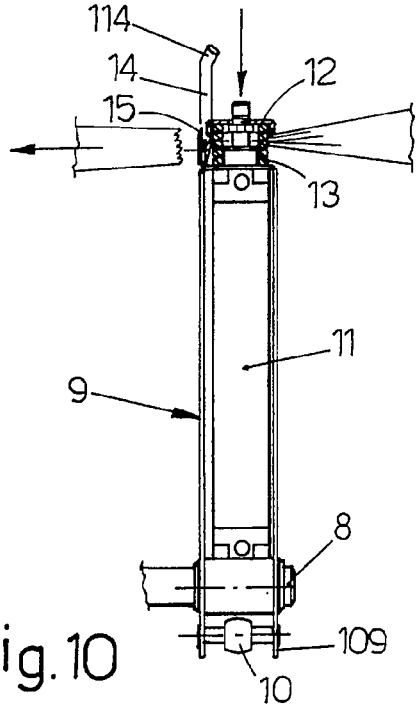
FIGS. 9 and 10 show frontally, with parts cross-sectioned and during subsequent working steps, the gripping and cutting unit which performs separation of the tail end of a wrapping from the new leading end of the film supplied by the distributor with the feed reel and which retains the said leading end for the start of the next working cycle.
Figure 9:
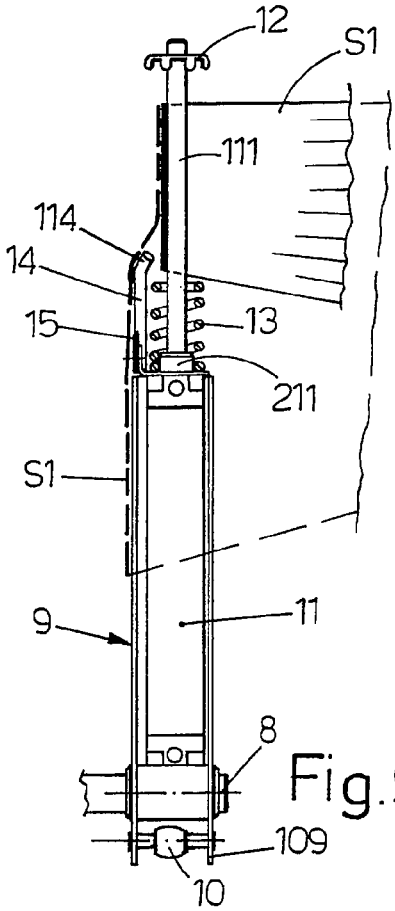

In sequence (FIG. 4), the reverse movement of the belt 2 is performed, so as to raise the tooth 7 which causes raising of the bottom edge of the last turn S1 and at the same time moves away from the penultimate turn S which extends elastically over the member 1. During this step, the last turn S1 is shortened transversely so that it is raised from the body 9, passes beyond the extension 14 and is arranged in contact with the rod 111 alone of the cylinder 11, as shown in continuous lines in FIG. 9. In sequence, as shown in FIGS. 5 and 8, the tooth 7 passes beyond the upper drive device 102 of the member 1 and insert the last turn S1 in the pocket Z formed by the penultimate turn S. During this step and during the next step shown in FIG. 6, where the last turn S1 is inserted fully inside the said pocket Z, a suitable quantity of film may be supplied tensioned by the distributor with the reel B. FIG. 6 shows how, while the tooth 7 inserts the last turn S1 inside the pocket Z, the penultimate turn S is gradually raised by the other tooth 7' and is made to pass over the top end of the member 1, firstly with its upper edge which is arranged elastically in contact with the wrapped load, closing the upper mouth of the said pocket Z. In suitable sequence, retraction of the rod 111 of the cylinder 11 is actuated so that it grips the last turn S between the cup member 12 and the top end of the spring 13 and then compresses this spring as shown in FIG. 10 so as to retain firmly this last turn and cause the portion thereof facing the load to co-operate with a transverse cutting means 15 which consists for example of a sawtooth blade fixed to the top of the box-shaped body 9 and protected inside the extension 14 and which separates the tail end of the wrapping which is about to be completed from the leading end of the film supplied by the distributor with the reel B which is firmly held between the parts 12 and 13. In synchronism with the said operation for cutting the tail end and retaining the new leading end of the film, the tooth 7' also causes the bottom edge of the penultimate turn S to pass over the member 1, so that the said turn S extends elastically downwards, adheres to the wrapped load C and closes the pocket Z inside which the tail end of the last turn S1 of the wrapping film remains firmly gripped. In order to ensure certain disengagement of the tooth 7' from the tail end of the film, the said tooth 7', in synchronism, is raised and brought into the start of cycle position. It is clear that in the apparatus and in the method according to the invention, the tail end of the wrapping film is controlled in a positive and certain manner for the whole of the fixing cycle, while ensuring that the same apparatus offers a high level of operational reliability.

In sequence, while the wrapped load moves away, the member 1 is pivoted downwards and the member 9 is also pivoted downwards, as already mentioned with reference to FIG. 1. The leading end of the film supplied by the distributor with the reel B is retained by the gripper unit 12, 13 which is closed and in the lowered position. When a new load has been positioned on the table T, after the latter has started the cycle for wrapping this load, when the first turn of the said wrapping film is suitably automatically fixed in position, the said gripper unit 12, 13 is opened with extension of the rod 111 and it is possible to envisage the operation of means—not shown in that known—which blow compressed air onto the section of the leading end of the film which would otherwise remain hanging from the load, so as to move it towards the load in such a way that it is incorporated in the next turns of the wrapping film.

The apparatus as described may also be used in rotating-arm wrapping machines or in ring machines and in this case will be positioned statically alongside the motor-driven rollerway which transports and positions correctly the load in the wrapping station. In ring machines, the said apparatus could be differently positioned on the structure which rotatably supports the ring, with an orientation overturned with respect to that shown, so as to be arranged along the path of the wrapping film only during the final stages of the tail end fixing cycle, all of which in a manner which can be deduced and easily realized by persons skilled in the art.

It is understood that the description refers to a preferred embodiment of the invention to which numerous variations and modifications, in particular of a constructional nature, may be made, these referring for example to the use of means other than the toothed belt 2, or to the use of at least two belts arranged alongside each other and each having one of the said teeth 7, 7' mounted thereon and to the provision of movement means which allow the selective operation of the said teeth, for example couplings of the electromagnetic or other type which could obtain their movement from a single gear motor 3. In order to simplify the action of the various components of the apparatus and/or so as to be able to produce the same apparatus with smaller dimensions, the distributor with the reel B for feeding the film may be provided with known means which are to reduce the width of the film supplied for formation of the said penultimate turn and/or last turn S, S1.

The invention claimed is:

1. Method for automatically fixing the tail end of the film for wrapping usually palletized loads, said film being supplied by a distributor with a reel (B) and with pre-stretching means, which is displaced parallel to the axis of the said load so as to wrap the latter in the direction of its height and which is made to perform a relative rotational movement about the same load, characterized by the succession of the following working steps performed at the end of each wrapping cycle:

a) Positioning along the side of the load and parallel thereto a straight member (1) and transversely extending over it a section of a penultimate turn (S) of the wrapping film so as to form a vertically open pocket (Z) between this turn and the wrapped load;

b) Moving an edge of the film portion of the said penultimate turn which touches the said straight member towards the other edge of the said turn so as to free space on the said straight member (1);

c) Extending over the free space of said straight member (1) a section of a last turn (S1) of the wrapping film, which, unlike the other turn (S), surrounds the load only partly since the said distributor with the reel (B) is arranged and positioned at a short distance and downstream of the said straight member (1);

d) The part of the said last turn (S1) situated on the said straight member is moved away from the said penultimate turn (S), is made to pass over the said straight member (1) and is inserted and pulled into the said pocket (Z), remaining temporarily connected to the said distributor with the reel (B);

e) The part of the said penultimate turn situated on the said straight member (1) is made to pass gradually over this member, coming out from the said end from where the tail end came out, so as to close gradually the said pocket;

f) Transversely cutting the section of the said last turn which projects from the pocket and which is connected to the said distributor so as to create and separate the tail end of the finished wrapping from the new leading end of the wrapping film which is retained by special means;

g) In synchronism with the said step of cutting the tail end and retaining the new leading end of the wrapping film, the penultimate turn of the film is made to pass over completely the said straight member so as to adhere to the wrapped load, close definitively the said pocket (Z) and trap firmly inside the latter the said tail end which is released by the pulling means.

2. Method according to claim 1, in which the said step of inserting and pulling the last turn (S1) of the wrapping, inside the pocket (Z) of the said penultimate turn (S) of the said wrapping is performed with the application of a pulling force which acts on the said last turn so as to prevent the latter from being subject to local tension.

3. Method according to claim 1, in which the said step of forming and cutting the tail end of the wrapping film is performed after the first of the edges of the penultimate turn (S) forming the pocket (Z) has been made to pass over the said straight member (1) and has extended elastically against the wrapped load, closing the said pocket at one end, in order to retain by means of friction inside the latter the section of the said last turn which is pulled inside the said pocket and from which the tail end of the wrapping will then be derived with the cutting step.

4. Method according to claim 1, in which, during the step involving insertion and pulling of the last turn (S1) of the wrapping film inside the pocket (Z) of the penultimate turn (S), a suitable quantity of film may be retracted and/or fed by the distributor with the feed reel (B), so as to avoid excessive tensioning of the said last turn (S1).

5. Apparatus for automatically fixing the tail end of the film for wrapping usually palletized loads, supplied by a distributor with a reel (B) and with pre-stretching means, which is displaced parallel to the axis of the said load so as to wrap the latter in the direction of the height and which is made to perform a relative rotational movement about the same load, in particular for implementing the method according to one or more of the preceding claims, characterized in that it comprises:

a) A straight member (1) of suitable length which, when at rest, is in a position where it does not interfere with the load wrapping film and which, during the initial step of fixing the tail end of the said wrapping film, is positioned along the side of the load, parallel to and at a short distance from the latter;

b) Means for wrapping the load with a penultimate turn (S) of the wrapping film so that a section of the latter rests transversely on the said straight member (1) and is situated at a distance from the wrapped load so as to form together with the latter an open pocket (Z);

c) Means for moving an edge of the portion of film of the said penultimate turn (S) which touches the said straight member (1) towards the other edge of the said turn so as to free space on the said straight member;

d) Means for resting on the free space of the said straight member (1) a section of a last turn (S1) of the wrapping film which, unlike the other turn, wraps the load only partly, there being envisaged means for stopping the said distributor with the reel (B) at a short distance and in a position downstream with respect to the same straight member;

e) Means for moving away the part of the said last turn (S1) situated on the said straight member (1) from the said penultimate turn (S), with a pushing force on the edge of the last turn which is directed towards the said penultimate turn so that the said last turn is made to pass over the said straight member (1) and is inserted and pulled into the said pocket (Z), remaining temporarily connected to the said feed distributor with the reel (B) of film;

f) Means for pushing the portion of the said penultimate turn (S) situated on the said straight member so as to cause it gradually to pass over this straight member (1) and come out from the same end of the latter as the end from which the last turn (S1) came out, so as to close gradually the said pocket (Z);

g) Means for transversely cutting the section of the said last turn (S1) which projects from the said pocket (Z) and which is connected to the said feed distributor with the reel (B) so as to create and separate the tail end of the finished wrapping from the new leading end of the wrapping film which is retained by special means;

h) Means for ensuring that, in synchronism with the operation of the said means for cutting and retaining the new leading end of the wrapping film, the last turn (S) of the film is made to pass over completely the said straight member (1) so as to adhere to the wrapped load, close definitively the said pocket (Z) and trap firmly the said tail end inside the latter.

6. Apparatus according to claim 5, in which the said straight member (1) has a length which is suitably greater than the width of the extendable film as supplied by the distributor with the reel (B), has a flat form, is directed with one of its edges towards the wrapped load (C) and has an end (101), from which the said last and penultimate turns of the wrapping film are pushed out, suitably rounded and provided with a means (102) for driving at least one conveyor consisting for example of a toothed belt (2) which travels guided inside a longitudinal groove (201) of the said member (1) which, at the other end, has a toothed pulley (202) keyed onto the axis of a small gear motor (3) fixed on the side of the said member (1), the said conveying belt (2) having, fixed thereon, oppositely synchronized, at least two teeth (7, 7'), preferably with rounded edges and with a substantially L-shaped and/or T-shaped side profile, which at the start of each working cycle are preferably positioned at the opposite ends of the member (1) in question and these teeth having the task of pushing the edges of the said last and penultimate turn, so as to implement the said method of fixing the tail end.

7. Apparatus according to claim 6, in which the said teeth (7, 7') have a tip and edges which are rounded and are made in a way such that they have a low coefficient of friction with respect to the film.

8. Apparatus according to claim 6, in which the said gear motor (3) is fixed onto one of the support flanges (104) of a fork-shaped end of an arm (4) which is pivotably joined together with a support structure (T) and which with the other end is connected to a reciprocating actuator (6) which is supported by the same support (T) and by means of the action of which the said member (1) may be brought from a horizontal rest position into an operative position along the side of the wrapped load (C) and parallel thereto.

9. Apparatus according to claim 6, in which the outer side of the said conveying belt (2) is coplanar with or slightly set back from the edges (301) of the longitudinal groove (201) of the member (1) inside which the said belt travels, and these edges (301) are suitably rounded and polished or in any case treated in order to facilitate sliding thereon of the film for forming and fixing the tail end of the wrapping.

10. Apparatus according to claim 5, characterized in that the forked and right-angled base (109) of a second straight member (9) is provided pivotably on a special support (T) in a position situated between the said member (1) and the feed distributor with the reel (B) of film, said base being hinged with a reciprocating actuator (10) fastened to the said support (T), by means of which the said second member (9) may be brought from a horizontal rest position into an active position parallel to the said first member (1), in order to force the last turn (S1) to touch in a certain and uniformly distributed manner the said first member (1), so as to be able to be acted on by its displacement teeth (7, 7'), this second member (9) being provided with gripper means for retaining the new leading end of the wrapping film supplied by the distributor with the reel (B) and cutting means (15) being envisaged for separating the said leading end from the tail end of the film of the wrapped load (C).

11. Apparatus according to claim 10, in which the second straight member (9) has, fixed therein, the body of a piston and cylinder unit (11), the rod (111) of which projects by a suitable amount from the said member (9) and has fixed at one end a jaw (12) for example in the form of an overturned cup, the top of the said member from where the said rod projects being provided with a protuberance (211) on which one end of a cylindrical spring (13) of limited height is fixed, alongside which spring the said member (9) has an extension of its edge intended to make contact with the said last turn (S1) of the wrapping film, this extension being formed, for example, by a round metal pin (14) welded to the said member (9) and terminating above the said spring (13) with an end (114) which is rounded and slightly bent towards the rod of the said cylinder (11) and a cutting means (15) being provided integrally with the said second member (9) and in a suitable position between the said spring (13) and the said extension (14).

12. Apparatus according to claim 10, characterized in that it is designed so that, when the said second straight member (9) is in the active position, the last turn (S1) of the wrapping film touches partly said member, partly touches its extension (14) and partly touches the rod (111) of the said cylinder (11) which is in the extended position.

13. Apparatus according to claim 6, characterized in that it comprises means so that, in synchronism with operation of the said first straight member (1), while the last turn (S1) is caused by a movable tooth (7) to pass over this member, owing to this displacement the same last turn leaves the second straight member (9), passes beyond the extension (14) and is arranged in contact with the said rod (111) of the cylinder (11), there being envisaged means which in synchronism with the operation of the said first member (1) cause retraction of said rod (111) which grips the last turn (S1) between its jaw (12) and the said spring (13) and then compresses this spring so as to grip firmly this last turn and cause the portion facing the load to co-operate with the said transverse cutting means (15) which separates the tail end of the completed wrapping from the leading end of the film supplied by the distributor with the reel (B), which remains firmly held between the said gripping means (12, 13).

14. Apparatus according to claim 13, characterized in that it comprises means for ensuring certain disengagement of the movable tooth (7) of the first straight member (1) from the tail end of the film inserted in the pocket of the wrapping (Z), for example reversing the movement of this tooth and bringing it back into the start of cycle position.

15. Apparatus according to claim 6, characterized in that it comprises means for ensuring that at the end of the cycle, the said straight members (1, 9) are brought into the horizontal rest position, with the new leading end of the wrapping film which remains fixed to this second straight member and which is released by the latter with the movement of the said jaw (12) away from the said spring (13), only when a new load has been positioned in the wrapping station and cycle for wrapping this load has started and after the first turn of the said wrapping film has been suitably automatically fixed in position, it being possible to envisage in synchronism activation of means which blow compressed air onto the section of the leading end of film which otherwise would remain hanging from the load, so as to move it towards the load, so that it is incorporated in the subsequent turns of the wrapping film.

16. Apparatus according to claim 6, characterized in that it may be used in rotating-table wrapping machines (T), with the pivot of the said first and second members (1, 9) being situated along the side of the said table, or in that it may be used also in rotating-arm wrapping machines or in ring machines, these members (1, 9) in this case being able to be positioned statically along the side of the motor-driven rollerway which positions the load in the wrapping station, or, in ring machines where the same apparatus may be differently positioned on the structure which rotatably supports the ring, with an orientation overturned with respect to that envisaged for the cases mentioned above.

17. Apparatus according to claim 6, characterized in that according to a variation of embodiment the said teeth (7, 7') of the said first straight member (1) may be fixed on respective conveying belts (2) and that means may be envisaged for actuating said belts and consequently said teeth in a selective manner most suitable for implementing the said method for fixing the tail end of the film for wrapping a load (C).

18. Apparatus according to claim 5, characterized in that, in order to simplify the action of its various components and/or in order to be able to design the same apparatus with compact dimensions, means able to reduce the width of the film supplied for formation of the said penultimate and/or said last turn (S, S1) may be envisaged in the distributor with the reel (B) feeding the film.

* * * * *